United States Patent [19]

Eucken

[11] Patent Number: 4,521,259

[45] Date of Patent: Jun. 4, 1985

[54] NITROGEN ANNEALING OF ZIRCONIUM AND ZIRCONIUM ALLOYS

[75] Inventor: Craig M. Eucken, Linn County, Oreg.

[73] Assignee: Teledyne Industries, Inc., Los Angeles, Calif.

[21] Appl. No.: 651,298

[22] Filed: Sep. 17, 1984

Related U.S. Application Data

[63] Continuation-in-part of Ser. No. 467,327, Feb. 17, 1983, abandoned, which is a continuation-in-part of Ser. No. 203,697, Nov. 3, 1980, abandoned.

[51] Int. Cl.[3] ..... C21D 1/56

[52] U.S. Cl. ..... 148/20.3; 148/11.5 F; 148/133

[58] Field of Search ..... 148/11.5 F, 13, 13.1, 148/20.3, 133

[56] References Cited

U.S. PATENT DOCUMENTS

| | | | |
|---|---|---|---|
| 2,804,410 | 8/1957 | Wyatt et al. | 148/133 |
| 3,787,223 | 1/1974 | Reedy | 148/133 |
| 4,000,013 | 12/1976 | MacEwen et al. | 148/11.5 F |
| 4,098,623 | 7/1978 | Ibaraki et al. | 148/133 |
| 4,183,773 | 1/1980 | Kawasoko et al. | 148/16 |

FOREIGN PATENT DOCUMENTS 555952 4/1958 Canada .

*Primary Examiner*—John P. Sheehan

*Attorney, Agent, or Firm*—Shoemaker and Mattare, Ltd.

[57] ABSTRACT

A method of continuously nitrogen annealing zirconium and zirconium alloys at temperatures at from 1000° F. to 1600° F. for from ½ minute to 10 minutes.

6 Claims, No Drawings

NITROGEN ANNEALING OF ZIRCONIUM AND ZIRCONIUM ALLOYS

This is a continuation in part of Ser. No. 467,327, filed Feb. 17, 1983, which is a continuation in part of Ser. No. 203,697, filed Nov. 3, 1980, both now abandoned.

BACKGROUND OF THE INVENTION

1. Field of the Invention

This invention relates to a continuous process for annealing zirconium and zirconium alloys. More specifically, it deals with the use of a nitrogen atmosphere which allows the process to be continuous.

2. Description of the Prior Art

The idea of continuous annealing of metals is old in the art. Even the idea of continuous annealing in a nitrogen atmosphere has been used in annealing steel and certain metals. This shown in U.S. Pat. No. 4,183,773, Kawasoko et al, wherein a hydrogen-nitrogen atmosphere is used.

It has also been known to nitride metals including zirconium for the purpose of producing hardness. This hardness, however, is effected at the expense of ductility.

The usual way of annealing zirconium or zirconium alloys is by vacuum annealing since these metals are very reactive and considerably more reactive than steel. This vacuum annealing is extremely expensive not only with regard to equipment, but also with regard to operation. There is a need for a continuous process for annealing zirconium and zirconium alloys for economic purposes. However, a nitrogen atmosphere which would be an inexpensive atmosphere, has been avoided because of the reactivity of these metals. This is also recognized by MacEwen et al, U.S. Pat. No. 4,000,013, where a vacuum atmosphere is stated as preferred over helium or argon which have been treated to remove all traces of deleterious substances such as oxygen, nitrogen, etc.

BRIEF SUMMARY OF THE INVENTION

1. Objects of the Invention

It is, accordingly, one object of the invention to provide a process for continuously annealing zirconium and zirconium alloys.

A further object of the present invention is to provide a process for continuously annealing zirconium and zirconium alloys in a nitrogen atmosphere.

A still further object of the present invention is to set forth a process for continuously annealing zirconium and zirconium alloys less expensively than vacuum anneal while still producing products having high yield strength, ultimate tensile strength and high ductility.

These and other advantages of the present invention will become apparent from the following detailed description and examples.

In accordance with the above objects, it has been found that zirconium and zirconium alloys can be continuously annealed. This process is possible using a nitrogen atmosphere, thus avoiding the more expensive and slower vacuum annealing process used in the past.

DETAILED DESCRIPTION OF THE INVENTION

The inventive concept of the present invention is to continuously anneal zirconium and zirconium alloys in the presence of a nitrogen atmosphere. Although the idea of using a nitrogen atmosphere with such highly reactive metals has been unthinkable in the past, it has now been found that it is not only possible, but that it produces a product having better properties than that produced by vacuum annealing. The reason this is possible is because the continuous process is so much faster than the batch vacuum annealing process that the metals are exposed to the heat and atmosphere for comparatively very short periods of time. Specifically, what takes about two hours to vacuum anneal now can be performed in a continuous process in less than three minutes. It has further been found that the reaction between these metals and nitrogen is slow enough to make this nitrogen annealing not only possible, but desirable.

The nitrogen annealing process of the present invention produces less grain growth because of the limited exposure to heat. This finer grain size is responsible for increased yield strength and ultimate tensile strength.

This nitrogen annealing process is also much more economical than vacuum annealing in that the product is produced much faster, the apparatus for continuous annealing is less expensive than that for vacuum annealing, and the production cost for maintaining a nitrogen atmosphere versus a vacuum atmosphere is considerably less.

Although nitrogen annealing has the above benefits, one must be careful not to anneal at too high temperatures or for too long a time since this will cause increased nitriding which must be removed or the ductility will suffer. If there is too heavy a nitride coating, it will become very expensive to remove.

The following equation serves to guide one in performing the invention while avoiding the above problem of too heavy nitrogen pick up or nitriding:

$$\text{Time} = a\ 2.7183^{(Q/R)\ 1/Temp\ ^\circ K.}$$

a = a constant for each alloy in the range of $3\times10^{-10}$ to $2\times10^{-13}$ Q/R = an activation energy constant which is in the range of 20,000 to 45,000

The following examples were made and tested for strength and formability, the results of which are illustrated in the tables set forth below. A Zircaloy-4 strip having the following composition was prepared in the following manner:

| Zircaloy-4 (nominally) | |
|---|---|
| 1.5% | Sn |
| 0.2% | Fe |
| 0.1% | Cr |
| balance | Zr |

This material was produced by hot forging in the beta phase, hot rolling in the alpha phase, and cold rolling at least 50% reduction with alpha phase intermediate anneals following each 30 to 40% reduction.

This material was split into two lots, one of which was vacuum annealed and one of which was nitrogen annealed, and subsequently tested for yield strength, ultimate tensile strength, elongation, ductility or formability, and finally for nitrogen and oxygen pickup. The results of these tests are set forth in the following tables.

The above zirconium alloy strip was nitrogen annealed for 3 minutes at 1300° F., and the strip was then tested both transversely and longitudinally for elongation, ultimate tensile strength, and yield strength. The results are shown in Table I.

TABLE I

| Example | % Elongation | Ultimate Tensile Strength psi | Yield Strength psi |
|---|---|---|---|
| 1. Zr-4, Trans. | 32 | 64,700 | 51,100 |
| 2. Zr-4, Trans. | 31 | 64,700 | 50,700 |
| 3. Zr-4, Trans. | 32 | 63,300 | 49,300 |
| 4. Zr-4, Long. | 32 | 63,800 | 47,500 |
| 5. Zr-4, Long. | 31 | 63,500 | 47,900 |
| 6. Zr-4, Long. | 31 | 63,800 | 48,600 |

Trans. = transverse testing
Long. = longitudinal testing

A comparison between the average of the results in Table I and the same alloys treated by vacuum annealing was made. This comparison is shown in the following Table II where there is also shown a comparison of grain sizes.

TABLE II

| Example | % Elongation | Ultimate Tensile Strength psi | Yield Strength psi | Grain Size |
|---|---|---|---|---|
| 7. Zr-4, Long | 34 | 60.6 | 48.9 | 9½ |
| 8. Zr-4, Trans. | 34 | 60.5 | 49.3 | |
| 9. Zr-4, Long. | 31 | 58.3 | 46.9 | 10 |
| 10. Zr-4, Trans. | 32 | 59.5 | 48.2 | |
| *11. Zr-4, Long. | 31.3 | 63.7 | 48.0 | 10½ |
| *12. Zr-4, Trans. | 31.7 | 64.2 | 50.4 | |

*Nitrogen annealed for 3 minutes at 1300° F.

In Table II, Examples 7 through 10 were vacuum annealed and can be compared to Examples 11 and 12 which have been nitrogen annealed as set forth above.

TABLE III

| Example | Temp. | % Elongation | Ultimate Tensile Strength psi | Yield Strength psi |
|---|---|---|---|---|
| *13. Zr-4, Trans. | 600° F. | 42 | 31,100 | 20,700 |
| *14. Zr-4, Trans. | " | 43 | 31,100 | 20,400 |
| *15. Zr-4, Trans. | " | 41 | 31,300 | 21,000 |
| *16. Zr-4, Long. | " | 46 | 35,300 | 18,300 |
| *17. Zr-4, Long. | " | 46 | 35,400 | 18,600 |
| *18. Zr-4, Long. | " | 46 | 35,300 | 18,200 |
| 19. Zr-4, Trans. | " | 43 | 26,900 | 17,500 |
| 20. Zr-4, Trans. | " | 43 | 27,000 | 17,500 |
| 21. Zr-4, Trans. | " | 44 | 27,200 | 17,600 |
| 22. Zr-4, Long. | " | 51 | 29,300 | 16,500 |
| 23. Zr-4, Long. | " | 51 | 30,100 | 15,900 |
| 24. Zr-4, Long. | " | 52 | 28,900 | 15,700 |
| *25. Zr-4, Trans. | R. T. | 31 | 69,400 | 61,200 |
| *26. Zr-4, Trans. | " | 31 | 68,700 | 61,000 |
| *27. Zr-4, Trans. | " | 31 | 69,100 | 60,600 |
| *28. Zr-4, Long. | " | 32 | 72,900 | 51,200 |
| *29. Zr-4, Long. | " | 28 | 73,700 | 50,900 |
| *30. Zr-4, Long. | " | 29 | 74,100 | 51,200 |
| 31. Zr-4, Trans. | " | 30 | 65,500 | 56,200 |
| 32. Zr-4, Trans. | " | 31 | 65,400 | 56,000 |
| 33. Zr-4, Trans. | " | 31 | 65,100 | 56,500 |
| 34. Zr-4, Long. | " | 32 | 69,600 | 49,400 |
| 35. Zr-4, Long. | " | 31 | 69,300 | 49,400 |
| 36. Zr-4, Long. | " | 30 | 70,200 | 50,600 |

*Nitrogen annealed for 3 minutes at 1300° F.
R. T. = Room Temperature

Table III further illustrates comparatively properties of Zircaloy-4 metal which has been nitrogen annealed versus the same Zircaloy-4 metal which has been vacum annealed.

Two strips of Zircaloy-4 were separately treated by nitrogen annealing and vacuum annealing and then tested for ductility and formability. The result of this test is represented in Table IV where 2T and 1.6T represent the bending of the metal around a mandrel having a radius two times and 1.6 times the thickness of the material, respectively.

TABLE IV

| Example | 2T | 1.6T |
|---|---|---|
| *37. Zr-4, Trans. | no cracks | no cracks |
| *38. Zr-4, Trans. | no cracks | no cracks |
| 39. Zr-4, Trans. | slight orange peel | slight orange peel |
| 40. Zr-4, Trans. | slight orange peel | slight orange peel |
| *41. Zr-4, Long. | no cracks | no cracks |
| *42. Zr-4, Long. | no cracks | no cracks |
| *43. Zr-4, Long. | no cracks | no cracks |
| 44. Zr-4, Long. | slight orange peel | slight orange peel |
| 45. Zr-4, Long. | slight orange peel | slight orange peel |

*Nitrogen annealed at 1300° F. for 3 minutes
Trans. = transverse testing
Long. = longitudinal testing In an attempt to determine the depth and amount of oxygen and nitrogen pickup from the annealing process, an Auger analysis was performed on Zircaloy-4, the results of which are shown in Table V.

EXAMPLE V

| Example | Position | Composition of Nitride Layer, Weight Percent | | | | | | | | |
|---|---|---|---|---|---|---|---|---|---|---|
| | | C | O | N | S | Fe | Sn | Zr | F | Si |
| I | AR | 22.1 | 5.9 | .55 | .72 | .63 | — | 69.0 | 1.1 | — |
| | Base (200Å) | 1.94 | .35 | — | — | .19 | .83 | 95.8 | — | .88 |
| II | AR | 9.2 | 12.5 | 1.7 | .42 | 1.1 | — | 71.5 | — | 3.2 |
| | 100Å | 11.0 | 2.2 | 3.65 | — | — | .77 | 82.2 | — | — |
| | Base (500Å) | 1.3 | .28 | — | — | .27 | .93 | 96.3 | — | .82 |
| III | AR | 8.7 | 15.4 | .37 | .27 | .95 | .47 | 70.9 | — | 2.8 |
| | 100Å | 5.9 | 12.6 | .51 | — | .66 | .32 | 79.1 | — | .83 |
| | 7000Å | 3.3 | 2.8 | — | — | .24 | .92 | 91.7 | — | .96 |
| IV | AR | 17.5 | 7.47 | .40 | — | 1.3 | .28 | 69.6 | — | 2.9 |
| | 700Å | 5.5 | 11.9 | .36 | — | 1.5 | .34 | 78.6 | — | 1.8 |

AR = As Received

Example I represents unannealed material in the as-received condition. Example II was annealed for 10 minutes at 1250° F. in pure nitrogen. Examples III and IV were annealed for 5 minutes 1250° F. in nitrogen; however, it was discovered that the furnace leaked during these examples and, therefore, there was a considerable amount of air in the furnace during the annealing.

Some tests made at different times and temperatures on Zircaloy-4 gave the result shown in Table VI.

TABLE VI

| Heat Treatment | Transverse | | | Longitudinal | | |
|---|---|---|---|---|---|---|
| | YS | UTS | El | YS | UTS | El |
| 3 Min. 704° C. | 59.00 | 68.00 | 31.0 | 47.05 | 73.20 | 32.0 |
| 6 Min. 704° C. | 60.90 | 70.20 | 29.67 | 48.60 | 74.00 | 31.67 |
| 6 Min. 732° C. | 59.67 | 69.70 | 30.0 | 46.40 | 74.73 | 31.67 |
| 4 Min. 760° C. | 59.73 | 64.43 | 31.0 | 47.87 | 74.63 | 32.0 |

Annealing trials performed on zicronium-2.5% columbium alloy strip at diferent times and temperatures produced the results shown in Table VII.

TABLE VII

| Heat Treatment | Room Temperature Tensile Test Results | | | | | |
|---|---|---|---|---|---|---|
| | Transverse | | | Longitudinal | | |
| | YS, ksi | UTS, ksi | El % | YS, ksi | UTS, ksi | El % |
| 2 Min. 732° C. | 87.0 | 91.3 | 17.0 | 66.4 | 91.1 | 26.0 |
| 4 Min. 732° C. | 88.5 | 95.2 | 16.3 | 64.6 | 93.7 | 21.3 |
| 8 Min. 732° C. | 89.6 | 97.1 | 17.3 | 62.1 | 92.2 | 20.3 |
| 1 Min. 760° C. | 86.6 | 95.1 | 17.7 | 65.4 | 93.7 | 25.0 |
| 2 Min. 760° C. | 85.7 | 96.8 | 17.3 | 66.5 | 94.5 | 21.7 |
| 4 Min. 760° C. | 85.2 | 95.5 | 18.0 | 68.3 | 98.8 | 22.0 |
| 8 Min. 760° C. | 84.9 | 95.5 | 18.3 | 66.2 | 96.8 | 20.7 |
| 1 Min. 815° C. | 85.4 | 95.4 | 19.3 | 65.2 | 96.5 | 20.0 |
| 2 Min. 815° C. | 90.2 | 102.3 | 17.3 | 64.7 | 96.3 | 20.3 |
| 4 Min. 815° C. | 85.5 | 98.0 | 15.7 | 67.3 | 96.6 | 15.3 |

Two additional batches of zirconium-2.5% columbium alloy strip were annealed at 760° C. for four minutes at temperature. Tensile test results for these two batches are shown in Table VIII.

TABLE VIII

| Batch | Transverse | | | Longitudinal | | |
|---|---|---|---|---|---|---|
| | YS | UTS | El | YS | UTS | El |
| 840392 | 85.7 | 89.3 | 18.7 | 64.0 | 88.2 | 25.0 |
| 840510 | 106.8 | 109.5 | 18.5 | 71.0 | 97.6 | 18.5 |

Annealing trials performed on pure zirconium strip at different times and temperatures produced the results shown in Table IX.

TABLE IX

| Heat Treatment | Vickers Hardness, HV10 | % Recrystal |
|---|---|---|
| 3 Min. 538° C. | 173 | 0 |
| 5 Min. 538° C. | 167 | 0 |
| 7 Min. 538° C. | 178 | 0 |
| 2 Min. 566° C. | 171 | 0 |
| 3 Min. 566° C. | 158 | 25 |
| 4 Min. 566° C. | 156 | 50 |
| 6 Min. 566° C. | 150 | 80 |
| 2 Min. 593° C. | 146 | 100 |
| 3 Min. 593° C. | 142 | 100 |
| 4 Min. 593° C. | 143 | 100 |
| 6 Min. 593° C. | 142 | 100 |
| 2 Min. 621° C. | 139 | 100 |
| 3 Min. 621° C. | 139 | 100 |
| 4 Min. 621° C. | 138 | 100 |

TABLE IX-continued

| Heat Treatment | Vickers Hardness, HV10 | % Recrystal |
|---|---|---|
| 6 Min. 621° C. | 137 | 100 |

Although most of the above nitrogen annealing performed on Zircaloy strip was performed at 1300° F. for 3 minutes, the nitrogen annealing can be performed at lower and higher temperatures inversely proportional to the residence time of the material in the furnace. Therefore, it is possible to produce an acceptable product at temperatures from 1000° to 1600° F. and times of treatment can be from ½ minute to 10 minutes. The parameters can, therefore, vary from 1 minute at 1250° F. to 5 minutes at 1200° F. to 10 minutes at 1150° F. The important thing is that the temperature and time coincide for a time sufficient to cause stress relief (recovery before recrystallization) but no longer than complete recrystallization. In this regard, the formula stated above applies.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the mete and bounds of the claims or that form their functional as well as conjointly cooperative equivalent are, therefore, intended to be embraced by those claims.

It is claimed:

1. A method of continuously annealing zirconium metal and its alloys comprising continuously passing the metal through an annealing furnace containing a nitrogen atmosphere while maintaining said metal at a temperature of from about 1000° F. to 1600° F. for from 0.5 to 10 minutes said time and temperature being inversely proportional and within the formula:

$$\text{Time} = a \times 2.7183^{(Q/R)\ 1/temp\ ^\circ K.}$$

wherein $a = 3 \times 10^{-20} - 2 \times 10^{-13}$ $Q/R = 20{,}000\text{–}45{,}000.$

2. The method of claim 1 wherein the metal is a zirconium metal strip.

3. The method of claim 1 wherein the temperature is maintained at about 1250° F. for 1 minute.

4. The method of claim 1 wherein the temperature is maintained at about 1200° F. for 5 minutes.

5. The method of claim 1 wherein the temperature is maintained at about 1150° F. for 10 minutes.

6. The method of claim 1 wherein the temperature is maintained at about 1300° F. for 3 minutes.

* * * * *